United States Patent [19]

Versaw et al.

[11] Patent Number: 4,827,239

[45] Date of Patent: May 2, 1989

[54] HEAT COLLECTOR

[75] Inventors: Douglas P. Versaw; Ronald L. Holden, both of Mansfield, Ohio

[73] Assignee: Therm-O-Disc, Incorporated, Mansfield, Ohio

[21] Appl. No.: 135,248

[22] Filed: Dec. 21, 1987

[51] Int. Cl.[4] ..... H01H 37/04; H01H 37/52

[52] U.S. Cl. ..... 337/380; 337/354

[58] Field of Search ..... 337/380, 354

[56] References Cited

U.S. PATENT DOCUMENTS

| | | | |
|---|---|---|---|
| 3,297,845 | 1/1967 | Mertler | 337/354 |
| 4,591,822 | 5/1986 | Versaw et al. | 337/380 |
| 4,623,866 | 11/1986 | Hutchison | 337/380 |

*Primary Examiner*—H. Broome

*Attorney, Agent, or Firm*—Jones, Day, Reavis & Pogue

[57] ABSTRACT

A heat collector for thermostatic fire detectors comprises a one-piece circular metal member having a closed central depression that forms the bottom of a bimetal snap disc chamber in a thermostatic switch.

7 Claims, 2 Drawing Sheets

HEAT COLLECTOR

BACKGROUND OF THE INVENTION

This application relates to the art of fire detectors and, more particularly, to fire detectors of the type mountable to a ceiling for sensing excessive temperatures, and operating a switch to sound an alarm or activate other devices. The invention is particularly applicable for use with fire detectors having thermostatic switch assemblies, and will be described with specific reference thereto. However, it will be appreciated that the invention has broader aspects, and can be used with other types of switch assemblies.

Fire detectors of the type using a thermostatic switch assembly commonly include a large metal heat collector disc attached to the switch assembly and extending outwardly therefrom. The heat collector receives heat from the environment and transfers same to a bimetal snap disc in the thermostatic switch assembly. Previous fire detectors of this type have had the heat collector welded or otherwise secured to the casing of the thermostatic switch assembly. This joint between the heat collector and the thermostatic switch assembly inhibits optimum heat transfer, and it would be desirable to eliminate such joint in order to improve heat transfer efficiency.

SUMMARY OF THE INVENTION

A fire detector of the type described includes a one-piece heat collector having a closed central depression that also forms the bottom of a bimetal snap disc chamber in a thermostatic switch assembly mounted on the heat collector. With this arrangement, there are no joints between the major area of the heat collector and the bottom of the bimetal snap disc chamber.

In one arrangement, the improved heat collector of the present application includes a circular metal member having an outer periphery and an inner circumferential flat area. A closed circular central depression is provided in the metal member to form the bottom of a bimetal snap disc chamber on a thermostatic switch assembly.

A plurality of circumferential corrugations are formed in the metal member between the flat area and the outer periphery. A plurality of circumferentially-spaced holes are provided in the flat area for movement of air from one side to the other of the heat collector. The holes preferably occupy part of the flat area and part of an inclined surface on a circumferential corrugation. With such an arrangement, the holes provide movement of air from one side to the other of the heat collector in directions both perpendicular and parallel thereto.

A ring member is welded to the flat area around the central depression for mounting a thermostatic switch assembly to the heat collector. A bimetal snap disc forming part of the switch assembly spans the central depression in the heat collector. Heat is efficiently transferred from all areas of the heat collector to the central depression therein for heating the bimetal snap disc.

It is a principal object of the present invention to provide an improved heat collector for use with fire detectors.

It is also an object of the invention to provide an improved fire detector.

It is a further object of the invention to provide an improved heat collector for use with a thermostatic switch assembly.

It is another object of the invention to provide an improved fire detector having a heat collector that conducts heat to the bottom of a bimetal snap disc chamber without having to transfer such heat through any joints.

DESCRIPTION OF PREFERRED EMBODIMENTS

Figure 1:
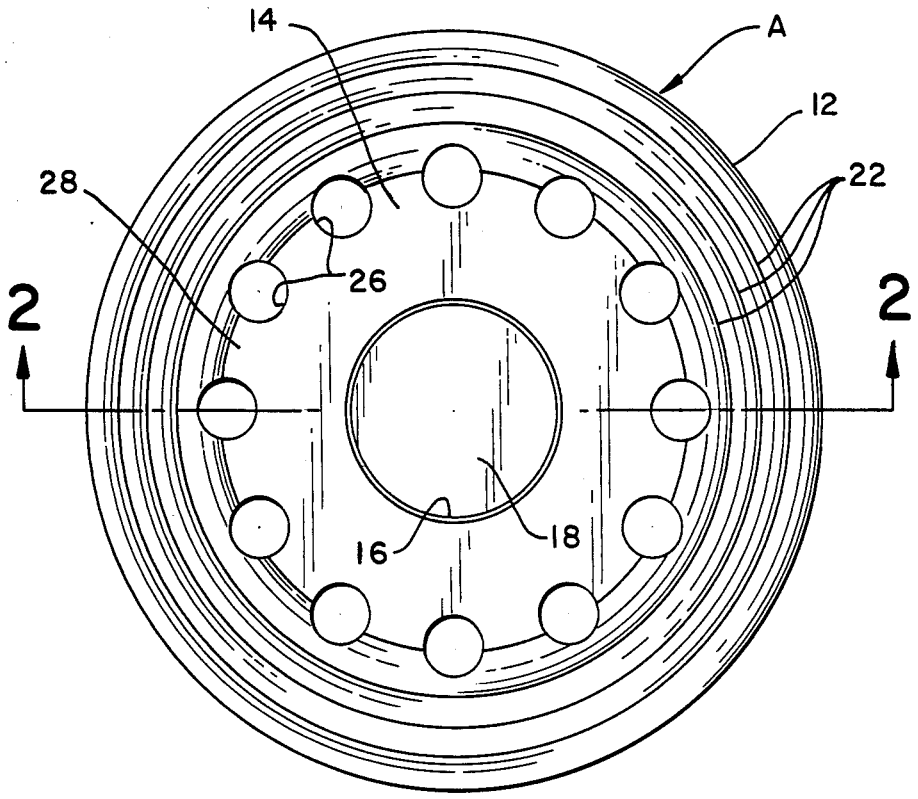
FIG. 1 is a top plan view of a heat collector constructed in accordance with the present application.
Figure 2:
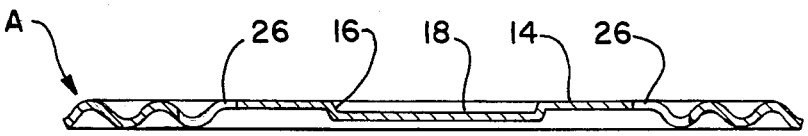
FIG. 2 is a cross-sectional elevational view taken generally on line 2—2 of FIG. 1.

Referring now to the drawing, wherein the showings are for purposes of illustrating preferred embodiments of the invention only, and not for purposes of limiting same, FIGS. 1 and 2 show a heat collector A in the form of a thin circular metal member. In FIGS. 1 and 2, the metal member is in the form of a disc, and it will be appreciated that modified shapes are possible.

One-piece circular metal member A includes an outer periphery 12 and a substantially flat inner circumferential area 14. A closed circular central depression 16 in metal member A has a closed bottom 18 spaced below flat area 14. The diameter of central depression 16 is less than the radius of metal member A. A plurality of circumferential corrugations 22 are formed in metal member A between flat area 14 and outer periphery 12.

A plurality of circumferentially-spaced holes 26 are provided in metal member 12 outwardly of central depression 16. Holes 26 are located on the periphery of a common circle 28, and are spaced-apart from one another a distance approximately the same as the diameter of each hole. However, it will be appreciated that other spacings are also possible. Holes 26 are preferably located such that they extend partly through flat area 14 and partly through an inclined side wall of a corrugation 22. With this arrangement, holes 26 open both perpendicular and parallel to metal member A so that air can flow into intimate heat transfer relationship with the heat collector.

Figure 3:
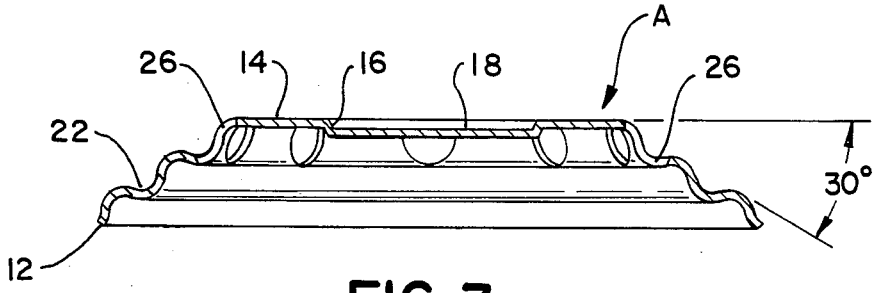
FIG. 3 is a view similar to FIG. 2, and showing an alternative form.

FIG. 3 shows a modified arrangement wherein the outer peripheral portion of the heat collector is bent downwardly at an angle 30 relative to flat area 14. Thus, the corrugated area of the heat collector, along with part of the flat area thereof, is generally frustoconical.

Figure 4:
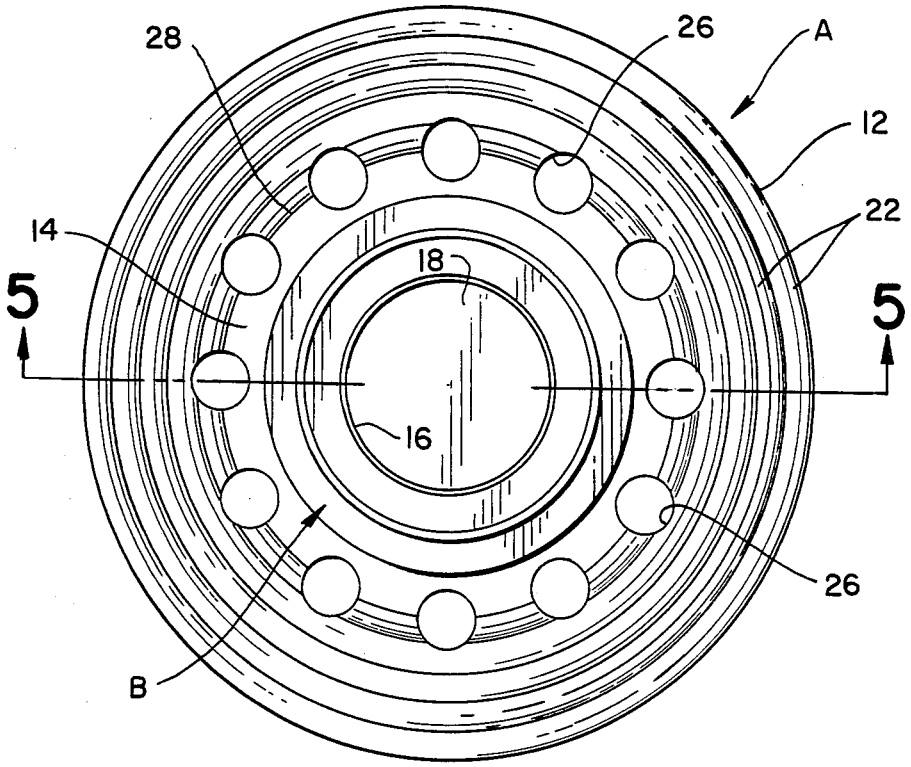
FIG. 4 is a top plan view of the heat collector of FIGS. 1 and 2 having a ring member attached thereto for receiving a thermostatic switch assembly.
Figure 5:
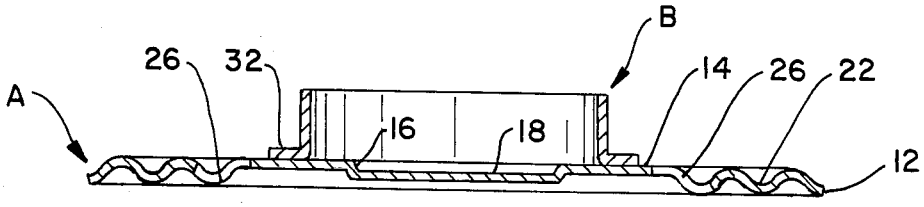
FIG. 5 is a cross-sectional elevational view taken generally on line 5—5 of FIG. 4.

FIGS. 4 and 5 show a ring member B having a diameter larger than the diameter of central depression 16, and positioned on flat area 14 in concentric relationship with central depression 16. Ring B has an outwardly extending bottom flange 32 that is welded or otherwise suitably secured to flat area 14. Holes 26 through heat collector A are located outwardly of ring B and its flange 32.

A thermostatic switch assembly C includes a plastic member 40 having a downwardly facing circular recess 42 therein receiving a bimetal snap disc 44. The diameter of snap disc 44 is slightly greater than the diameter of central circular depression 16 so that the outer peripheral portion of snap disc 44 rests on flat area 14 and spans depression 16. Thus, bottom 18 of central depression 16 in heat collector A defines the bottom of the chamber for bimetal snap disc 44.

A central hole through plastic member 40 slidably receives an actuator 50 that cooperates with snap disc 44 and with a movable arm 52 having a movable switch contact 54 cooperating with a fixed contact 56. Movable switch arm 52 may be attached by a rivet 58 or the like to an upper plastic member 60 having an internal cavity in which movable switch arm 52 is located. A downwardly extending circumferential wall 62 on plastic member 60 is cooperatively received in a suitable circumferential recess on plastic member 40. The upper end portion of ring member B is deformed inwardly as indicated at 64 over an outer circumferential shoulder on wall 62 of upper plastic member 60. This secures the switch assembly to the heat collector.

In the arrangement shown and described, the fire detector is more thermally responsive than prior arrangements. The one-piece heat collector provides faster and more efficient transfer of heat to the bimetal snap disc. The bottom of the snap disc chamber is an integral continuation of the remaining area of the heat collector A, and it is not necessary to transfer heat through any joints before the heat reaches the snap disc chamber.

Figure 6:
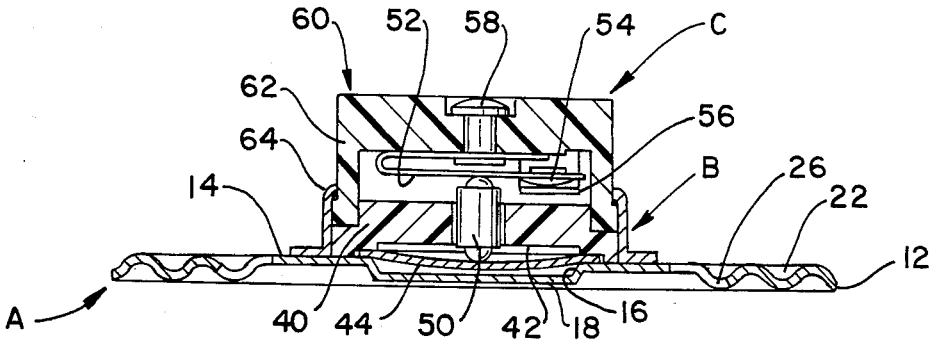
FIG. 6 is a view similar to FIG. 5, and showing a thermostatic switch assembly mounted to the heat collector.

When snap disc 44 of FIG. 6 reaches a predetermined temperature, it snaps upwardly to take an opposite bow, and moves actuator 50 upwardly to separate movable contact 54 from fixed contact 56. Obviously, operation of the snap disc can be used to open or close a switch for sounding an alarm or operating other devices.

Heat collector A is characterized by being made from one piece of substantially homogeneous metal having no joints therein. This contrasts with prior arrangements wherein the outer area of the heat collector is attached at an inner edge to the outside surface of a casing forming part of a bimetal disc chamber. In such prior arrangements, the heat collector and the bottom of the bimetal disc chamber are not one-piece, and the heat must be transferred through the joint.

Although the invention has been shown and described with respect to preferred embodiments, it is obvious that equivalent alterations and modifications will occur to others skilled in the art upon the reading and understanding of this specification. The present invention includes all such equivalent alterations and modifications, and is limited only by the scope of the claims.

We claim:

1. A one-piece heat collector comprising a circular metal member having an outer periphery and an inner circumferential flat area, a plurality of circumferential corrugations between said flat area and said outer periphery, and a closed central depression inwardly of said flat area, said depression having a bottom spaced below said flat area on one side thereof, a plurality of circumferentially-spaced holes in said metal member between said depression and said outer periphery, each said hole extending partly into said flat area and partly into one of said corrugations.

2. The heat collector of claim 1 including a ring member extending upwardly from said flat area and having an outwardly extending bottom flange welded to said flat area, said holes in said metal member being outwardly of said bottom flange.

3. The heat collector of claim 1 wherein said corrugations extend from said metal member on the same side of said flat area as said depression.

4. The heat collector of claim 3 wherein said metal member slopes downwardly and outwardly from said flat area to said outer periphery on the same side of said flat area as said depression.

5. A thermostatic switch assembly including a metal member having a central circular depression therein, a bimetal snap disc spanning said depression, said metal member including an integral heat collector portion extending outwardly from said depression and having a plurality of circumferential corrugations therein, a circumferential flat area between said depression and said heat collection portion, a ring member extending upwardly from said flat area in surrounding relationship to said depression and said snap disc, said ring member having an outwardly extending bottom flange attached to said flat area, and a plurality of circumferentially-spaced holes in said heat collector portion outwardly of said ring member.

6. A thermostatic switch assembly including a metal member having a central circular depression therein, a switch housing mounted on said metal member and enclosing a bimetal snap disc spanning said depression, said metal member having an integral flat circumferential area outwardly of said depression and said metal member including an integral heat collector portion extending outwardly and downwardly from said flat area on the same side thereof as said depression for collecting heat from an environment and transferring same to the area of said depression and hence to said snap disc.

7. The switch of claim 6 wherein said housing includes a ring member extending upwardly from said flat area and having an outwardly extending flange attached to said flat area.

* * * * *